US005346002A

United States Patent [19]

Swilik, Jr. et al.

[11] Patent Number: 5,346,002

[45] Date of Patent: Sep. 13, 1994

[54] CELL PANEL WITH EXTRUDED BURNER TARGET PLATES AND PROCESS FOR MAKING SAME

[75] Inventors: Robert C. Swilik, Jr., Indianapolis; Thomas P. Bruce, Columbus; Rex R. Mills, Indianapolis; Michael J. Larsen, Danville, all of Ind.

[73] Assignee: Carrier Corporation, Syracuse, N.Y.

[21] Appl. No.: 119,010

[22] Filed: Sep. 9, 1993

[51] Int. Cl.[5] ..... P24H 3/00

[52] U.S. Cl. ..... 165/173; 126/110 R; 29/890.03

[58] Field of Search ..... 165/164, 173; 126/99 R, 126/99 C, 110 R, 116 R; 29/890.03

[56] References Cited

U.S. PATENT DOCUMENTS 4,848,314 7/1989 Bentley ..... 126/116 R 5,042,453 8/1991 Shellenberger ..... 126/116 R X

*Primary Examiner*—John C. Fox

[57] ABSTRACT

A cell panel for a gas furnace having a burner box containing combustion burners includes burner target plates formed by an extrusion process from the sheet material forming the cell panel. The burner target plates include a concave side positioned to face the discharge side of a corresponding burner, and a convex side upon which the flared inlet port of a corresponding heat exchanger cell may be securely seated.

15 Claims, 3 Drawing Sheets

CELL PANEL WITH EXTRUDED BURNER TARGET PLATES AND PROCESS FOR MAKING SAME

BACKGROUND OF THE INVENTION

1. Field of the Invention

This invention relates in general to gas furnaces and, in particular, to the cell panel positioned between the burner box and heat exchanger cells of a gas furnace. More specifically, but without restriction to the particular embodiment hereinafter shown and described, this invention relates to burner target plates formed in the cell panel by extrusion.

2. Discussion of the Prior Art

Gas furnaces typically include a primary heat exchanger positioned adjacent a burner box containing burners. During operation of the furnace, a blower moves circulating air over the heat exchanger to produce heated air that is directed to a desired location. Gas is supplied to the burner box by a gas manifold having orifices that direct the gas into the burners. The gas exiting the burners is ignited by an ignitor provided in the burner box. The burners allow combustion of the gas as well as direct heat into the heat exchanger. The typical heat exchanger includes cells with a channel or pass formed in each cell to direct the flow of heat and flue gas produced by combustion. These cells are positioned side by side in a parallel manner and are provided with a predetermined spacing to allow the blower air to flow around the cells. The blower air is thus heated by convection as it moves over the cells.

Each of the channels in the primary heat exchanger cells includes a flared inlet port as well as a discharge port. A sheet metal panel or cell panel having burner target plates is typically provided to position the burner box relative to the cells contained in the heat exchanger. The burner target plates provided in the cell panel serve two functions in that they provide a seat for the flared inlet port of a corresponding heat exchanger panel while also providing a zone or target area with a central opening at which a corresponding burner is directed so that heat and flue gas produced by combustion is directed into the corresponding heat exchanger cell.

Prior art burner target plates are individually manufactured in a separate stamping process and then either fastened to large stamped openings provided in the cell panel or similarly fastened to a smaller sheet metal panel secured to the discharge side of the burner box. In the former arrangement, the burner box has an un-paneled discharged side which is secured to the cell panel to cover the area containing the target plates.

The residential heating industry has advanced with the advent of condensing gas furnaces. These furnaces typically included a primary heat exchanger as well as a condensing heat exchanger. A blower in these condensing heat furnaces similarly provides circulating air flow over both heat exchangers to produce heated air that may be directed to a desired location by a system of ductwork and registers.

In such condensing furnaces, both the primary heat exchanger and the condensing heat exchanger include cells with a channel or pass formed therein to direct the flow of flue gas produced by combustion. These cells in both the primary and secondary heat exchangers are positioned side by side in a parallel manner and are provided with a predetermined spacing to allow blower air to flow around both groups of heat exchanger cells.

Gas is similarly provided to the condensing furnace by a gas manifold having orifices that direct the gas into burners contained in a burner box. The gas is ignited by an ignitor as it exits the burners contained in the burner box. The heat and flue gas produced by combustion is then directed into the primary heat exchanger cells and induced to move through the heat exchangers.

Each of the channels provided in the primary heat exchanger cells eventually terminates at a discharge port. The discharge ports of the primary heat exchanger are typically aligned and secured in a first sheet metal panel forming the discharge side of the primary heat exchanger.

The condensing heat exchanger of the furnace is configured in a similar manner to its primary heat exchanger. A series of side by side condensing cells is provided. Each of these condensing cells has an inlet port for receiving flue gas discharged from the primary heat exchanger. The inlet ports of the condensing heat exchanger cells are aligned and secured in a second sheet metal panel forming the inlet side of the condensing heat exchanger. The two heat exchangers are mounted together to form a single intrical unit capable of receiving and heating clean circulating air provided from the blower. These condensing gas furnaces similarly include a cell panel including burner target plates for aligning the primary heat exchanger cell and directing burner discharge into the cells.

Although the condensing gas furnace is an advancement over prior gas-fired furnaces including only a primary heat exchanger, the cell panels typically used in these condensing gas furnaces are similar to those used in the prior single heat exchanger furnaces. The cell panels in current condensing gas furnaces also require the manufacturing of individual burner target plates that are fastened to large openings provided in the burner box area of the cell panel or similarly fastened to openings provided on the discharge side of the burner box which would then be mounted to an appropriate opening in the cell panel.

OBJECTS AND SUMMARY OF THE INVENTION

It is, therefore, an object of the present invention to improve gas furnaces having a primary heat exchanger with cells and a cell panel.

It is a further object of the present invention to form burner target plates in the material forming the cell panel of a gas furnace.

A further object of the present invention is to reduce the cost of manufacturing a cell panel having burner target plates for receiving the flared inlet ports of corresponding heat exchanger cells of a gas furnace.

Still another object of the present invention is to position the primary heat exchanger cells of a gas furnace in a parallel manner to allow heat transfer between the cells and circulating blower air moving over the cells.

Yet another object of the present invention is to extrude burner target plates in a cell panel from the material forming the cell panel so that heat and flue gas discharged from the burners is directed into corresponding channels provided in the primary heat exchanger cells of a gas furnace.

An additional object of the present invention is to reduce the time required to assemble the cell panel and primary heat exchanger cells of a gas furnace.

These and other objects are attained in accordance with the present invention wherein there is provided a cell panel for a gas furnace having a burner box containing combustion burners. Each of the burners is utilized to combust gas and direct the resultant heat and combustion products into the flared inlet port of a corresponding primary heat exchanger cell. The cell panel includes a rigid sheet member of substantially flat surface area formed from an extrudable material. The cell panel is provided with a plurality of collinear burner target plates formed in the rigid sheet member. The number of burner target plates corresponds to the number of burners provided in the burner box which, in turn, corresponds to the number of heat exchanger cells provided in the primary heat exchanger. An appropriate number of burner target plates will vary with furnace capacity and any such particular number is not considered a function of the present invention.

Each of the plates is provided with a central opening. The plates are extruded from the sheet material forming the cell panel. The extruded burner target plates include a concave side positioned to face the discharge side of a corresponding combustion burner, and a convex side being formed so that the flared inlet port of a corresponding primary heat exchanger cell can be seated thereon. In this manner, when each of the flared inlet ports of the primary heat exchanger cells is seated upon and secured to the convex side of a corresponding burner target plate, the primary heat exchanger cells are aligned within the furnace to allow heat transfer between the cells and the circulating blower air. The extruded burner target plates formed in the cell panel are each further provided with a bevelled flange segment that is oval in configuration and that extends outwardly from the flat surface of the rigid sheet member forming the cell panel. The bevelled flange segment has a distal edge that forms the boundary of a raised planar region including the central opening. A truncated cusp member that is annular in configuration is extruded from the sheet material forming the raised planar region. The annular cusp member extends outwardly from the raised planar region thereby giving depth to the central opening.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing with like components throughout indicated by like reference numerals, wherein.

DETAILED DESCRIPTION OF A PREFERRED EMBODIMENT

Figure 1:
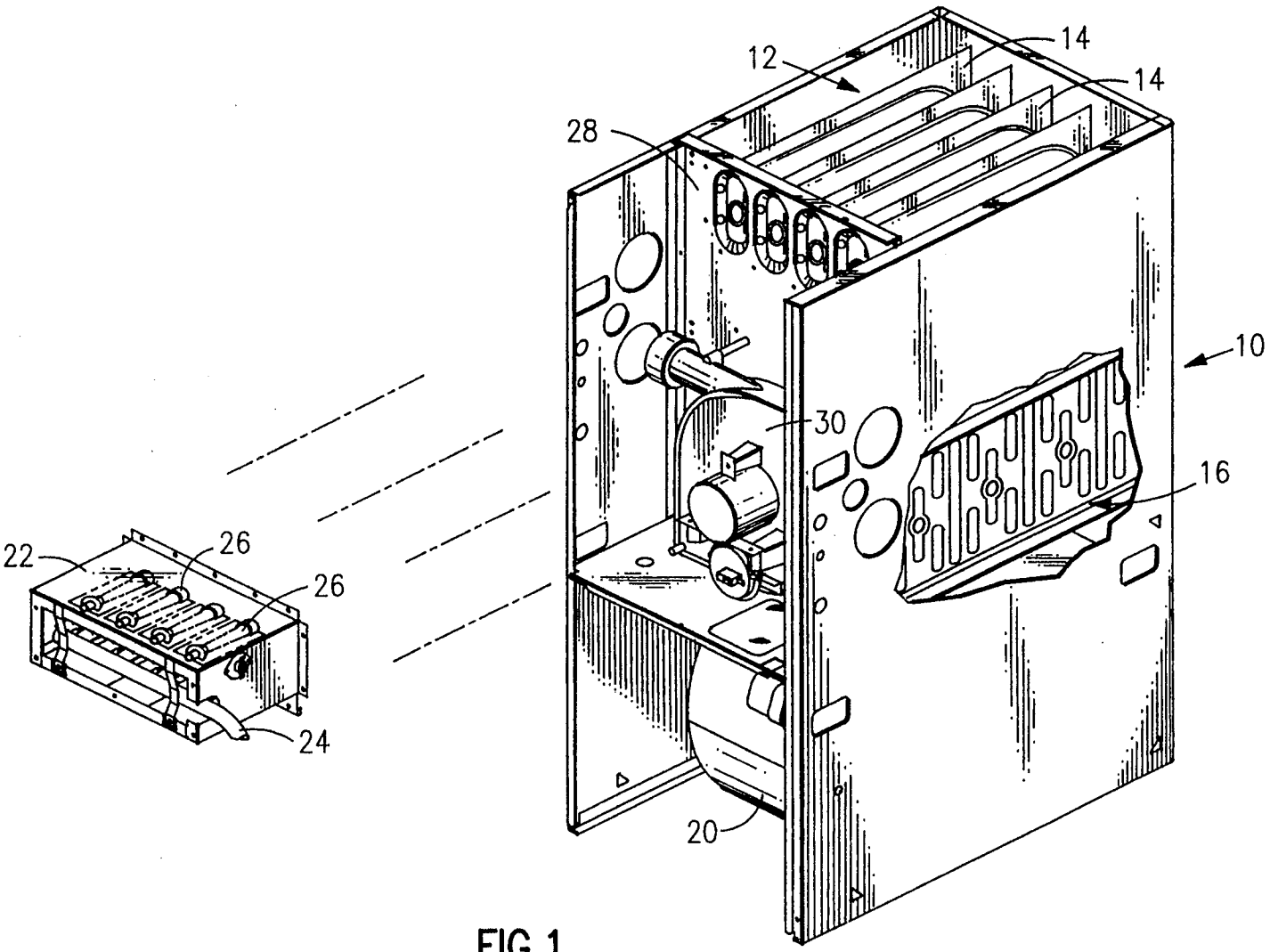
FIG. 1 is a perspective view of a condensing gas furnace incorporating the cell panel of the present invention and showing the furnace burner box disassociated from the cell panel.

Referring first to FIG. 1, there is shown a gas-fired condensing furnace 10 including a primary heat exchanger 12 having heat exchanger cells 14. A condensing heat exchanger 16 is shown positioned below the primary heat exchanger 12. The condensing heat exchanger 16 includes a number of condensing heat exchanger cells 18 as represented by the single cell 18 shown in phantom in FIG. 2. A blower 20 is provided adjacent to the heat exchangers 12 and 16 to move clean circulating air over the heat exchangers during operation of the furnace.

The gas furnace 10 also includes a burner box 22 which is supplied gas by a gas manifold 24. The gas manifold 24 contains orifices (not shown) that direct the supply gas into burners 26. The burner box 22 containing the burners 26 is mounted to a cell panel 28 when the furnace 10 is assembled. The cell panel 28 is preferably made of aluminized steel. Upon ignition of the gas provided to the burners 26, an inducer 30 is activated to induce the flow of heated flue gas through the heat exchangers 12 and 16.

Figure 2:
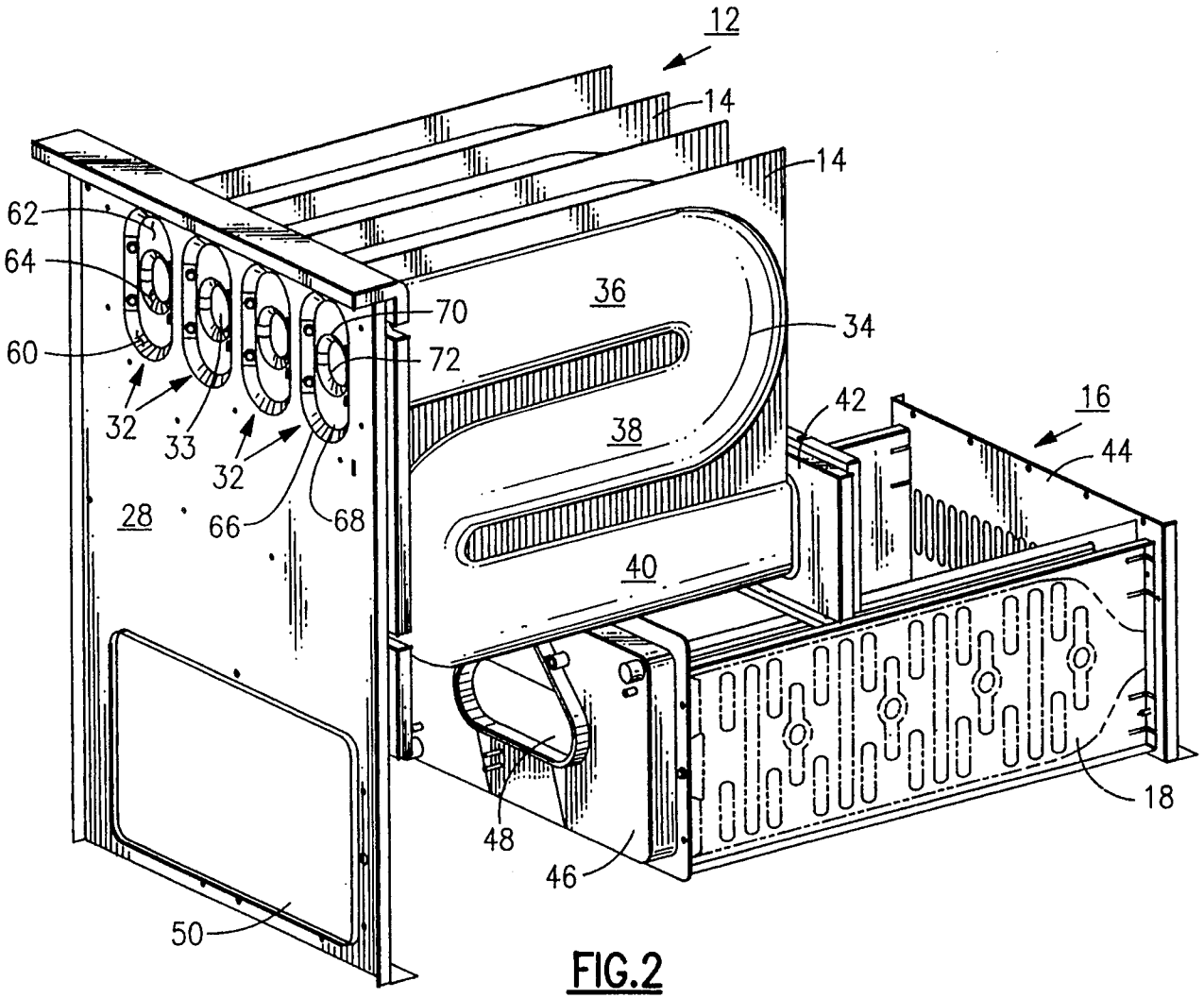
FIG. 2 is a perspective view of the primary and condensing heat exchangers provided in the condensing furnace of FIG. 1.
Figure 3:
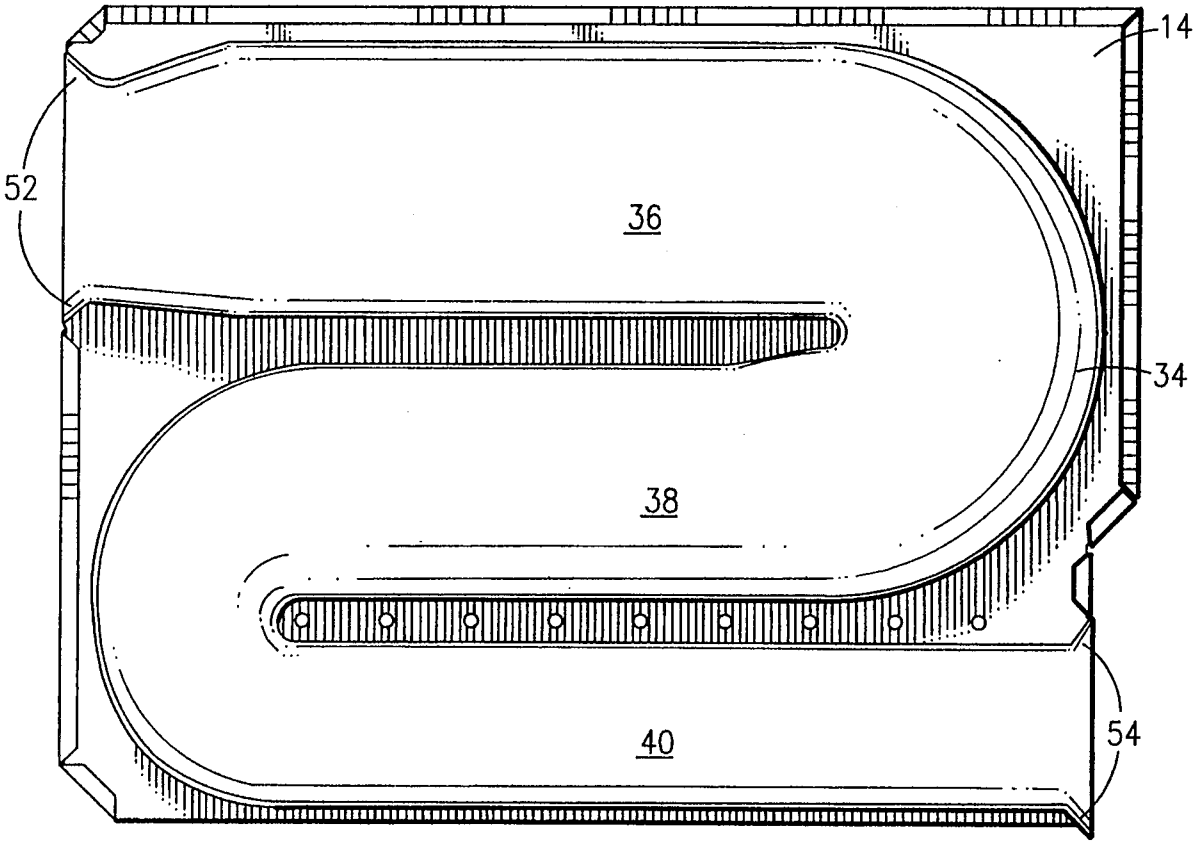
FIG. 3 is a side elevational view of one of the primary heat exchanger cells shown in FIG. 2.

The cell panel 28 includes burner target plates 32 as shown in FIG. 2. Each of the burner target plates 32 includes a central opening 33 and each of the primary heat exchanger cells 14 includes a corresponding channel 34. The central opening 33 is preferably oval in shape but may be of any suitable shape including circular. The channels 34 each include a first pass 36, a second pass 38, and a third pass 40 as shown in FIG. 2 and FIG. 3. The primary heat exchanger 12 includes a discharge side 42 while the condensing heat exchanger 16 includes a inlet side 44 and a discharge side 46. The discharge side 46 of the condensing heat exchanger 16 includes an inducer mounting opening 48. The inducer 30 is mounted onto mounting opening 48 as shown in FIG. 1 and, during operation of the furnace, induces flow of heated flue gas through the heat exchangers 12 and 16 as well as moves the flue gas into venting pipe (not shown) so that the flue gas produced by combustion may be appropriately vented. The cell panel 28 also includes a large rectangular opening 50, FIG. 2, which allows the cell panel 28 to be mounted against the discharge side 46 of the condensing heat exchanger 16 so that the heat exchangers 12 and 16 may be properly positioned and aligned on top of each other. As most clearly shown in FIG. 3, the primary heat exchanger cells 14 each include a flared inlet port 52 and a flared discharge port 54. The flared discharge ports 54 are secured and aligned in the sheet metal member forming the discharge side 42 of the primary heat exchanger 12 as shown in FIG. 2.

Figure 6:
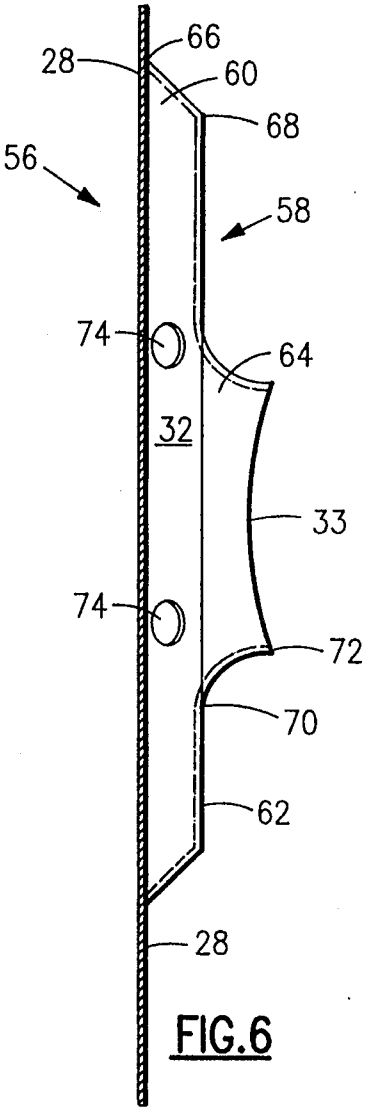
FIG. 6 is an enlarged partial side elevational view, taken along section line 6—6 of FIG. 5, showing a burner target plate according to the present invention.
Figure 4:
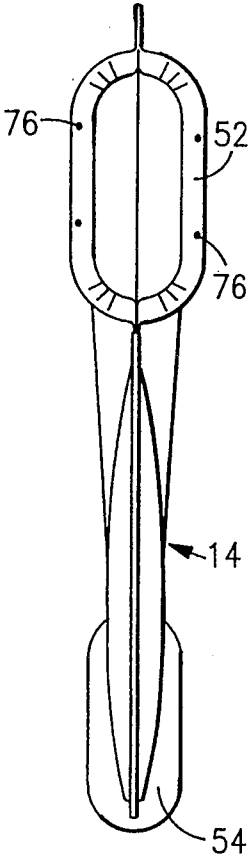
FIG. 4 is a front elevational view of the heat exchanger cell shown in FIG. 3.
Figure 5:
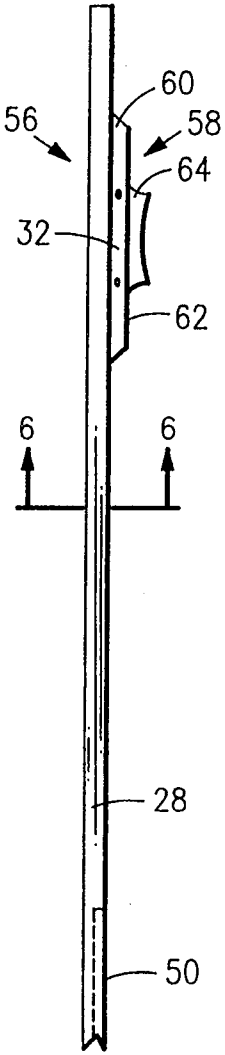
FIG. 5 is a partial side elevational view of the cell panel according to the present invention.

Referring now to FIGS. 2, 5 and 6, there is shown that the burner target plates 32 generally include a concave side 56 and a convex side 58. More particularly, each of the burner target plates 32 includes a bevelled flange segment 60 that is oval in configuration, a raised planar region 62 and a truncated cusp member 64. As shown in FIGS. 3, 4 and 5 the flared inlet port 52 of each of the primary heat exchanger cells 14 is also oval in configuration and corresponds in size and shape to the raised bevelled flange segment 60 so that the flared inlet port 52 may be snugly seated upon the convex side of the bevelled flange segment 60.

As specifically shown in FIGS. 2 and 6, the flange segment 60 includes an oval proximal edge 66 which is contiguous with the sheet metal forming the flat surface area of the cell panel 28. The flange segment 60 also includes an oval distal edge 68 which forms the boundary of the raised planar region 62. The truncated cusp member 64 similarly includes an oval proximal edge 70 which is contiguous with the sheet material forming the raised planar region 62. The truncated cusp member 64 finally terminates at an oval distal edge 72. The bevelled flange segment 60, raised planar region 62, and truncated cusp member 64 each have an outer surface, as shown in FIG. 6, which join one another at their edges to form the convex side 58 of the burner target plate 32. Similarly, the bevelled flange segment 60, raised planar region 62, and truncated cusp member 64 each include an inner surface, as shown in FIG. 2. In a like manner, these inner surfaces join together to form the concave side 56 of the burner target plates 32. The bevelled flange segment 60 is further provided with preformed screw holes 74 which correspond to preformed screw holes 76 provided in the flared inlet port 52 of each primary heat exchanger cell 14 as shown in FIG. 4.

Upon assembly of the condensing gas furnace 10, each of the flared inlet ports 52 of the primary heat exchanger cells 14 is seated upon the outer surface of the bevelled flange segment 60 and secured thereto by sheet metal screws passing from the inner surface of the bevelled flange segment 60 into the corresponding screw holes 76 provided in the flared inlet port of 52. Alternatively, self-taping screws may be employed thus eliminating the need to preform the screw holes 76. During operation of the condensing furnace 10, heated flue gas is discharged from the burners and directed at the concave side 56 of the burner target plates 28. The central opening 33 is given depth and definition by the truncated cusp member 64 which protrudes into the first pass 36 of the primary heat exchanger cells 14 when the cells 14 are mounted to the cell panel 28. In this manner, the truncated cusp member 64 provides a channeling effect that smoothly directs the flow of heated flue gas into the first pass 36 of the channel 34.

There has thus been shown and described a design for the burner target plates 32 that allows for directing the flow of hot flue gas produced by operation of the furnace into the channel 34 of the cells 14 and that also allows for quick and ready assembly of the cells 14 to the cell panel 28.

In accordance with one aspect of the present invention, the burner target plates 32 are extruded from the sheet material forming the cell panel 28 rather than being individually manufactured by a stamping process and then secured to large openings provided in the cell panel 28 as was done in prior cell panels. This extrusion process indirectly reduces the time required to assemble the cell panel to the heat exchanger cells 14 because the burner target plates are made a part of the cell panel 32 thus requiring no assembly of individual burner target plates to the cell panel. The cost of manufacturing the complete cell panel 28 is directly reduced because only one manufacturing process is required rather than several stamping and assembly processes.

The extrusion process for forming the burner target plates 32 in the sheet material of the cell panel 28 includes a two stage process including a preliminary notch and pierce stage followed by a forming stage. The forming stage includes both drawing and extruding. In the notch and pierce stage, the rectangular sheet material forming the cell panel 28 is positioned between a first set of dies. This first set of dies blanks or stamps out the required number of central openings 33 in the sheet material as well as the rectangular opening 50 for receiving the condensing heat exchanger 16. Also at this stage, the corners of the rectangular sheet material are notched out so that 90° flange segments may be formed around the periphery of the cell panel 28. Once the blank square material forming the cell panel 28 has been notched and pierced, it is then moved to a forming station.

The forming station includes a second set of dies for drawing and extruding the burner target plates 32 of the present invention. The second set of dies include forming elements for fabricating the burner target plates 32 around the previously pierced openings 33. One die of the second set includes a protruding forming element corresponding to the shape and size of the concave side 56 of the burner target plate 28, while the other die of the second set includes a recessed forming element corresponding to the shape and size of the convex side 58 of a respective burner target plate 32. Each of the forming elements in the second set of dies include a forming section corresponding to the bevelled flange segment 60, raised planar region 62, and the truncated cusp member 64 of the burner target plate 32. Each die of the second set is relatively large weighing between 5,000 and 9,000 pounds, with dimensions of up to 48 by 48 by 60 inches. Each die is connected to a set of nitrogen cylinders that control the movement of the dies during the forming process. Mill oil on the sheet material forming the cell panel provides sufficient lubrication during the drawing and extruding process. As the nitrogen cylinders are activated when the previously notched and pierce cell panel 28 is positioned therebetween, the forming elements corresponding to the shape of the burner target plates are brought together.

As a result of the weight of the dies and the pressure provided by the nitrogen cylinders, the bevelled flange segments 60 are formed by drawing, that is, stretching and shaping the material in the immediate vicinity to form the flange segment 60. The raised planar region 62 remains coplanar with the distal edge 68 during the drawing formation. The planar region 62 is thus moved a distance away from the substantially flat surface area of the sheet material comprising the cell panel 28. The forming elements in the second set of dies also engage the sheet material of the raised planar region 62 immediately surrounding the central openings 33 to further extrude this material to form a respective truncated cusp member 64 around each of the previously pierced central openings 33. The second set of dies are then moved away from each other and the cell panel 28 completed in accordance with the present invention is removed therefrom and inventoried for later assembly.

The cell panel of the present invention including the extruded burner target plates formed therein is not limited to use in condensing heat furnaces and has been shown and described in configuration therewith only by way of illustration. A cell panel including the extruded burner target plates in accordance with the present invention may be effectively used in a verity gas-fired furnaces including those with only one heat exchanger. The four burner target plates shown in the accompanying drawing figures is by way of illustration only and is not intended as a limitation of the number or placement of burner target plates formed in accordance with the present invention.

Thus, while this invention has been described in detail with reference to a single preferred embodiment, it should be appreciated that the present invention is not limited to that precise embodiment. Rather, in view of the present disclosure, many modifications and variations would present themselves to those of skill in the art without departing from the scope and spirit of this invention, as defined in the following claims.

What is claimed is:

1. A cell panel for a gas furnace having a burner box containing combustion burners, each of the burners for directing heat into the flared inlet port of a corresponding heat exchanger cell to heat a flow of circulating air passing over the cells, the panel comprising:

a rigid sheet member of substantially flat surface area formed from an extrudable material, the sheet being positioned between a discharge side of the burners and the inlet ports of the heat exchanger cells; and a plurality of burner target plates formed in said rigid sheet member, each of the plates having a central opening and being extruded from the sheet material to form a concave side being positioned to face the discharge side of a respective combustion burner, and a convex side being formed so that the flared inlet port of a corresponding heat exchanger cell can be seated thereon;

whereby when each of the flared inlet ports of the heat exchanger cells is seated upon and secured to the convex side of a respective burner target plate, the heat exchanger cells are aligned within the furnace to allow heat transfer between the cells and the circulating air.

2. The cell panel according to claim 1 wherein each of the burner target plates includes:

a bevelled flange segment having an inner and an outer surface, being oval in configuration, and extending outwardly from the flat surface of said rigid sheet member, said bevelled flange segment further having a distal edge and a proximal edge that is contiguous with the flat surface of said rigid sheet member;

a raised planar region including the central opening and having an inner and outer surface, said raised planar region being bound by and contiguous with said distal edge of the flange segment; and a truncated cusp member having an inner and outer surface, being annular in configuration, and extending outwardly from said raised planar region, said truncated cusp member having a distal edge and a proximal edge being contiguous with said raised planar region, the concave side of each of said burner target plates thereby being formed by the inner surfaces of the flange segment, planar region, and cusp member and the convex side of each of the target plates being formed by said outer surfaces of the flange segment, planar region, and cusp member.

3. The cell panel according to claim 2 wherein the flared inlet port of each of the heat exchanger cells is oval in configuration and formed to seat snugly upon the outer surface of a corresponding bevelled flange segment to thereby align the cells within the furnace while allowing the corresponding truncated cusp member to protrude into a channel provided in the heat exchanger cell.

4. The cell panel according to claim 3 wherein said bevelled flange segment further includes four holes spaced thereabout, each of these flange holes corresponding to a hole in the flared inlet port of the heat exchanger cells so that the cell panel and heat exchanger cells can be secured together by sheet metal screws.

5. The cell panel according to claim 4 wherein the burner box is secured to said rigid sheet member so that the discharge side of each of the combustion burners is positioned proximate a corresponding burner target plate to center the burner on the central opening of the plate whereby heat and flue gas discharged from the burner is directed through the opening and into the channel formed in the heat exchanger cell.

6. The cell panel according to claim 1 wherein the material forming said rigid sheet member is aluminized steel.

7. A cell panel for use in a gas furnace having a burner box containing combustion burners, each of the burners for directing heat into the flared inlet port of a corresponding heat exchanger cell to heat a flow of circulating air passing over the cells, said cell panel comprising:

a rigid sheet member of substantially flat surface area formed from an extrudable material, the sheet being positioned between a discharge side of the burners and the inlet ports of the heat exchanger cells; and a plurality of burner target plates formed in said rigid sheet member, each of the plates having a central opening and being extruded from the sheet material to form a concave side being positioned to face the discharge side of a respective combustion burner, and a convex side being formed so that the flared inlet port of a corresponding heat exchanger cell can be seated thereon, each of the burner target plates further including;

a bevelled flange segment having an inner and outer surface, being oval in configuration, and extending outwardly from the flat surface of said rigid sheet member, said bevelled flange segment further having a distal edge and a proximal edge being contiguous with the flat surface of said rigid sheet member;

a raised planar region including the central opening and having an inner and outer surface, said raised planar region being bound by and contiguous with said distal edge of the flange segment; and a truncated cusp member having an inner and outer surface, being annular in configuration, and extending outwardly from said raised planar region, said truncated cusp member having a distal edge and a proximal edge being contiguous with said raised planar region, the concave side of each of said burner target plates thereby being formed by the inner surfaces of the flange segment, planar region, and cusp member and the convex side of each of the target plates being formed by said outer surfaces of the flange segment, planar region, and cusp member.

8. The cell panel according to claim 7 wherein the flared inlet port of each of the heat exchanger cells is oval in configuration and formed to seat snugly upon the outer surface of a corresponding bevelled flange segment to thereby align the cells within the furnace while allowing the corresponding truncated cusp member to protrude into a channel provided in the heat exchanger cell.

9. The cell panel according to claim 8 wherein said bevelled flange segment further includes four holes spaced thereabout, each of these flange holes corresponding to a hole in the flared inlet port of the heat exchanger cells so that the cell panel and heat exchanger cells can be secured together by sheet metal screws.

10. The cell panel according to claim 9 wherein the burner box is secured to said rigid sheet member so that the discharge side of each of the combustion burners is positioned proximate a corresponding burner target plate to center the burner on the central opening of the plate whereby heat and flue gas discharged from the burner is directed through the opening and into the channel formed in the heat exchanger cell.

11. The cell panel according to claim 7 wherein the material forming said rigid sheet member is aluminized steel.

12. A process for simultaneously forming the concave and convex sides of a burner target plate in sheet material comprising the cell panel in a gas furnace having a burner box containing gas combustion burners, each of the burners for directing heat through a central opening formed in the target plate and into a corresponding heat exchanger cell, each of the heat exchanger cells having a flared inlet port that seats upon the convex side of the burner target plate so that the cells are aligned in the furnace to allow heat transfer between the cells and clean circulating air passing through the heat exchanger, said process including the steps of:

piercing a series of collinear central openings in the sheet material forming the cell panel, each opening being positioned in an area of sheet material corresponding to the area forming a respective burner target plate;

securing said sheet material between dies having forming elements, one of the dies having a first forming element corresponding in size and shape to the convex side of a respective burner target plate and the other die having a second forming element corresponding in size and shape to the concave side of the respective target plate, said two forming elements capable of mating with each other while the sheet material is positioned therebetween; and causing the dies to move toward each other so that the mating forming elements engage respective sides of the sheet material in the area of a corresponding burner target plate opening to form a respective burner target plate.

13. The process according to claim 12 wherein the step of causing the dies to move toward each other includes the steps of:

drawing, simultaneously, inner and outer surfaces of a bevelled flange segment from said sheet material so that the flared inlet port of a corresponding heat exchanger cell is seatable on the outer surface of the bevelled flange segment, the flange segment thereby having a distal edge and a proximal edge being contiguous with the sheet material surrounding a respective plate;

forming a raised planar region having a respective central opening, from the sheet material in the plane containing the distal edge of said bevelled flange segment, said forming step occurring concurrently with said drawing step; and extruding a truncated cusp member from the sheet material immediately surrounding a corresponding central opening, said truncated cusp member extending the sheet material away from said raised planar region and terminating with a distal edge surrounding the central opening whereby when the flared inlet port of a corresponding heat exchanger cell is seated upon said bevelled flange segment, the extruded cusp member extends into a channel provided in the heat exchanger cell.

14. A cell panel for use in a gas furnace having a burner box containing combustion burners, each of the burners for directing heat into the flared inlet port of a corresponding heat exchanger cell to heat a flow of circulating air passing over the cells, said cell panel comprising:

a rigid sheet member of substantially flat surface area formed from an extrudable material, the sheet being positioned between the discharge side of the burners and the inlet ports of the heat exchanger cells; and a plurality of collinear burner target plates formed in said rigid sheet member, each of the plates having a central opening and being extruded and drawn from the sheet material to form a concave side being positioned to face the discharge side of a corresponding combustion burner, and a convex side being formed so that the flared inlet port of a corresponding heat exchanger cell can be seated thereon.

15. The cell panel according to claim 14 wherein each of the burner target plates further includes:

a bevelled flange segment having an inner and an outer surface, being oval in configuration, and extending outwardly from the flat surface of said rigid sheet member, said bevelled flange segment further having a distal edge and a proximal edge being contiguous with the flat surface of said rigid sheet member;

a raised planar region including the central opening and having an inner and outer surface, said raised planar region being bound by and contiguous with said distal edge of the flange segment; and a truncated cusp member having an inner and outer surface, being annular in configuration, and extending outwardly from said raised planar region, said truncated cusp member having a distal edge and a proximal edge being contiguous with said raised planar region;

the bevelled flange segment being formed by simultaneously drawing the inner and outer surfaces of the segment from said sheet material so that the flared inlet port of a corresponding heat exchanger cell is seatable on the outer surface of the bevelled flange segment, said drawing process thereby forming the distal edge of the flange segment and the proximal edge thereof being contiguous with the sheet material surrounding the burner plate;

the raised planar region formed by moving an area of sheet material bound by the distal edge of the flange segment with the plane containing the distal edge while the bevelled flange segment is being drawn; and the truncated cusp member being formed by extruding sheet material from the area immediately surrounding a corresponding central opening, said truncated cusp member extending the sheet material away from said raised planar region and terminating with a distal edge surrounding the central opening whereby when the flared inlet port of a corresponding heat exchanger cell is seated upon said bevelled flange segment, the extruded cusp member extends into a channel provided in the heat exchanger cell.

* * * * *